US006120646A

United States Patent [19]

Snekkenes et al.

[11] Patent Number: 6,120,646

[45] Date of Patent: Sep. 19, 2000

[54] FEEDING SYSTEM OF FEEDING A CELLULOSE MATERIAL

[75] Inventors: Vidar Martin Snekkenes; Bo Gösta Svanegård; Bror Lennart Gustavsson, all of Karlstad, Sweden

[73] Assignee: Kvaerner Pulping AB, Sweden

[21] Appl. No.: 09/055,813

[22] Filed: Apr. 6, 1998

[51] Int. Cl.[7] ..... D21C 7/00

[52] U.S. Cl. ..... 162/236; 162/237; 162/246; 162/415; 162/DIG. 2

[58] Field of Search ..... 162/236, 237, 162/246, 415, DIG. 2

[56] References Cited

U.S. PATENT DOCUMENTS

| | | | |
|---|---|---|---|
| 4,092,212 | 5/1978 | Richter et al. | 162/19 |
| 5,700,355 | 12/1997 | Prough | 162/246 |
| 5,736,006 | 4/1998 | Prough | 162/52 |
| 5,795,438 | 8/1998 | Stromberg et al. | 162/52 |

FOREIGN PATENT DOCUMENTS

| | | |
|---|---|---|
| 2312679 | 3/1972 | Germany . |
| 1375705 | 2/1988 | U.S.S.R. . |

*Primary Examiner*—Sean E Vincent
*Attorney, Agent, or Firm*—Fasth Law Offices; Rolf Fasth

[57] ABSTRACT

A feeding system for feeding comminuted cellulose containing material and liquid to a continuously operating treatment vessel. The feeding system comprises a chute, operating at a first pressure, a high pressure feeder sluices the material to a second pressure, that is higher than the first pressure, for further conveyance to the treatment vessel. The high pressure feeder also receives a return liquid flow from the treatment vessel at the second pressure and recirculates a recirculation flow to the chute. The high pressure feeder is in fluid communications, regarding both the liquid and the material, with the recirculation flow when any of the pockets of the high pressure feeder is in a location which corresponds to an outlet for the recirculation flow.

15 Claims, 3 Drawing Sheets

FEEDING SYSTEM OF FEEDING A CELLULOSE MATERIAL

TECHNICAL FIELD

The present invention relates to a feeding system for feeding a comminuted cellulose containing material and a liquid to a continuously operating treatment vessel.

BACKGROUND AND SUMMARY OF THE INVENTION

Continuously operating digesters for cooking comminuted cellulose containing material to paper pulp have been known for a long time and hence also feeding systems for such digesters. The requirements of the feeding system are, among other things, that the cellulose material, hereinafter called chips, should be evenly fed from a low (atmospheric) pressure to a higher pressure, that the chips should be heated at the same time as vapor and gases are removed from the chips and replaced with water or condensate, and that the feeding system should be as inexpensive as possible in terms of investment costs and operating costs.

A conventional feeding system typically includes a chip bin, a chip meter, a low pressure feeder, a steaming vessel, a chip chute and a high pressure feeder. The function of the high pressure feeder is to convey the cellulose material, including some liquid, to a continuous digester or to a pre-impregnation vessel, that operates at a relatively high pressure. Between the high pressure feeder and the impregnation vessel or digester, there is conventionally a top circulation, which comprises a feed line for feeding a mixture of chips and impregnation liquid to the vessel, and a return liquid line for separating the impregnation liquid from the chips. A top separator is arranged at the top of the impregnation vessel or the digester for feeding the chips into the impregnation vessel or digester at the same time as a portion of the impregnation liquid is separated off and pumped with a pump through the return liquid line back to the high pressure feeder. The high pressure feeder is equipped with a rotor with pockets so that one of the pockets is always in a low pressure position and in fluid communication with the chute. At the same time, another pocket is always in a high pressure position and open in connection with the impregnation vessel or digester via the feed line. When a rotor pocket which is, to a degree, filled with chips, is moved into the high pressure position, i.e., in direct connection with the top circulation, the rotor pocket is flushed clean by the liquid from the return liquid line and the suspension of chips and impregnation liquid is then fed into the top of the impregnation vessel or digester via the feed line. The liquid that flows in a circulation loop on the low pressure side of the high pressure feeder, which loop is conventionally equipped with a pump, is at the same time feeding chips from the chute into one of the next pockets of the high pressure feeder so that this pocket is, to a degree, filled with chips. The circulation loop is also equipped with a sand trap and a tubular screen, referred to as an in-line drainer. Furthermore, a level tank is, via a line from the in-line drainer, connected to the return liquid line of the top circulation.

This conventional system was developed a long time ago when the production volumes of continuous pulp mills were perhaps just one tenth of the volume that modern pulp mills produce today. Accordingly, when the conventional feeding system was developed, the machines used were mush smaller. For example, the pump that was disposed in the circulation loop, for recirculating liquid to the chute on the low pressure side of the high pressure feeder, was rather small and hence needed to be protected from chips that might enter the circulation loop together with the liquid that was discharged from the high pressure feeder. To provide this protection, the high pressure feeder was equipped with a screen device, a so called strainer plate, at its outlet leading to the circulation loop. The intention was that the liquid should pass the screen and that the chips should remain in the pocket of the high pressure feeder to give a high filling degree of the pocket. In practice, however, the screen was partially plugged every time a pocket was filled with chips. This resulted in a filling degree that was only about 50–70% of the total filling volume of chips of the pockets. The rest of the filling volume was filled with liquid. This should be compared with the filling efficiency in the chute, which theoretically should be able to be reached in the high pressure feeder. The theoretical filling efficiency in the chute is about 80–85% of the total filling volume. When the rotor turns, the strainer plate is often scraped free from the chips, but the problem re-occurs when the next pocket comes in the same position. The partial filling degree results in an inefficient operation and in that the high pressure feeder must be operated at a relatively high rotary speed that, in turn, leads to a substantial wear on the equipment.

In addition, the operational volume should be relatively large in order to accommodate the high pressure feeder that must be positioned at a relatively high level due to the required suction pipe for the pump on the low pressure liquid side of the high pressure feeder. Also, the operational volume must be large enough to accommodate the sand trap, in-line drainer and level tank. These requirements increase the investment and operating costs.

Surprisingly, it has now been found that a well functioning feeding system can be provided that operates without a screening device in the high pressure feeder and also without an in-line drainer and a level tank. The feeding system according to the present invention further enables the pockets of the high pressure feeder to be filled to a theoretical maximum degree, i.e., to the same degree as the filling efficiency in the chute.

As mentioned above, the machines in modern high production pulp mills are much larger than they were at the time when the conventional feeding systems were developed. In particular, the pump in the circulation loop, for recirculating the liquid to the chute on the low pressure side of the high pressure feeder, is much larger today and is capable of handling a large amount of chips in the liquid flow, since the size of the chips themselves is not much different from what it has always been. An important feature of the present invention is that the screening device that prevented the chips from entering the circulation loop can be excluded, which results in several advantages.

Firstly, when a pocket of the high pressure feeder is moved towards the low pressure position, the pocket is full with liquid from the return liquid flow from the digester or pre-impregnation vessel, hereinafter called the treatment vessel. When the pocket reaches the low pressure position, the liquid is displaced with the mixture of chips and liquid that is present in the chute so that the same filling efficiency as in the chute can be achieved. The filling efficiency in the chute is normally about 80–85% of the total volume since some excess liquid is required for the chip column to be able to move down into the high pressure feeder.

Secondly, the required operational level of the high pressure feeder can be lowered. This is a consequence of the fact that there is essentially no suction pipe needed for the pump in the recirculation flow of the circulation loop since there is no pressure drop across a screening device. Also, the conventional level tank and its in-line drainer can be excluded from the system, which results in reduced investment and operating costs as well as in a smaller building volume. One reason for the possibility of excluding the level tank and the in-line drainer is that in the feeding system of the present invention, there is always a liquid communication between the pumps on the liquid side of the high pressure feeder and the chute. This means that a chute liquid level control valve can be placed in connection with one of these pumps for regulating the liquid level in the chute. In the conventional system, there is no such liquid communication when the screening device is plugged and the chute liquid level control valve must be connected with a level tank, normally between the in-line drainer and the level tank.

Another advantage is that the rotary speed of the pockets in the high pressure feeder of the present invention can be increased to a speed that is up to twice as high as in a conventional feeding system. Thereby, there is a major increase in the capacity of the high pressure feeder.

An additional advantage of the feeding system of the present invention is that the pump, hereinafter called the first pump, in the recirculation conduit can be coupled in series with a second pump that pumps liquid from the low pressure recirculation conduit to the high pressure return line from the treatment vessel. This means that the pump head of the first pump can be added to the pump head of the second pump so that the second pump may be one standard pump instead of, as in the conventional system, two standard pumps or one high pressure pump with several impellers. This results in a major reduction in investment and operating costs.

According to another aspect of the present invention, the recirculation flow, i.e., the volumetric flow that is discharged from the high pressure feeder on its low pressure side, is related by a factor 0.8–1.5 to the volumetric flow which is handled by the high pressure feeder. The volumetric flow through the high pressure feeder on the low-pressure side can be calculated as the volume of the pockets in the high pressure feeder multiplied with the rotary speed of the high pressure feeder and by a factor two (since the pockets are filled twice in each complete rotation). Another way of calculating the volumetric flow is by dividing the incoming chip flow (as measured in a chip mater) by a factor 0.5–0.9. This factor corresponds to the degree of chip filling of the high pressure feeder.

According to yet another aspect of the invention, a sand trap is installed in the return liquid line. This location has the benefit, as compared to the conventional location in the circulation loop, of providing a steady flow without any essential fluctuations in its Velocity. The sand trap consists of a cyclone which has to be optimized for a certain flow velocity and operates better in the relatively steady return liquid flow from the treatment vessel. In the alternative, the sand trap may be installed in the chute. A further advantage of moving the sand trap from its conventional location is that the sand is not circulated in the recirculation flow on the low pressure side of the high pressure feeder so that the wearing effect on the equipment is avoided. These alternative placements of the sand trap can of course also be included in other types of feeding systems.

DETAILED DESCRIPTION

Figure 1:
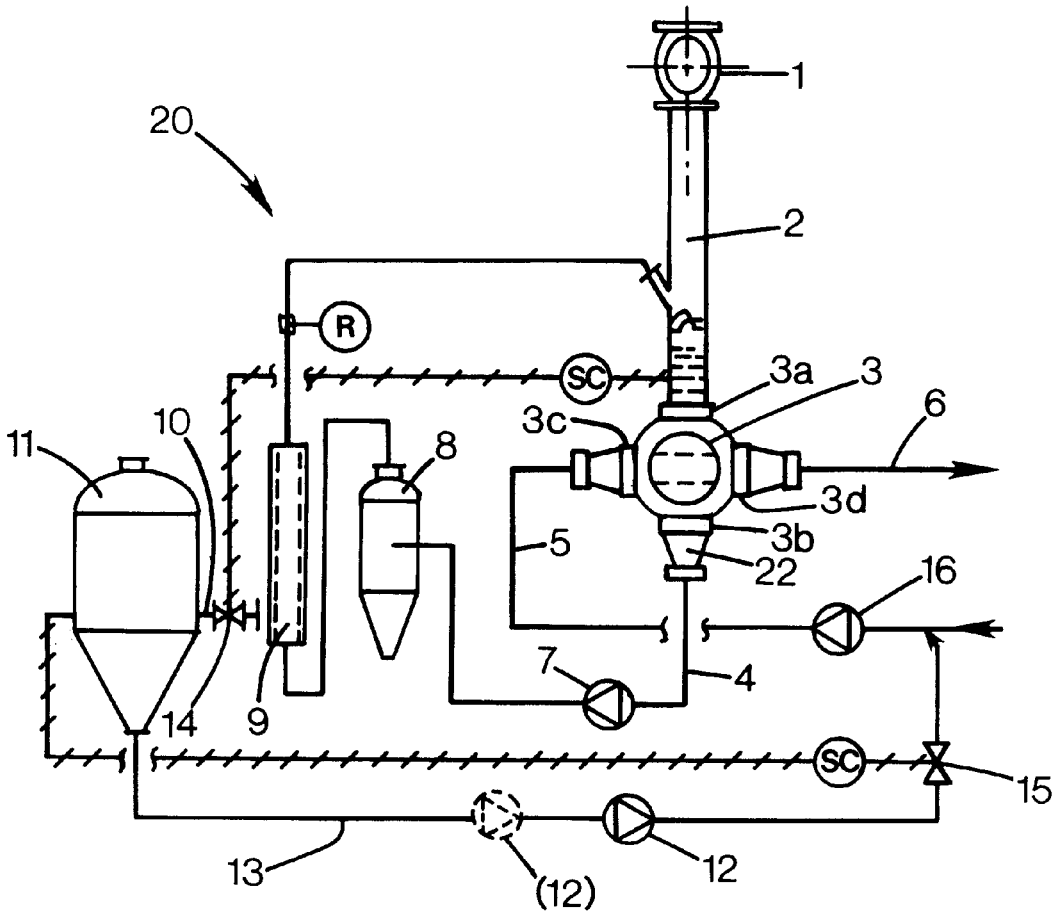
FIG. 1 PRIOR ART
FIG. 1 is a schematic view of a prior art feeding system.

FIG. 1 shows a feeding system 20 according to a conventional prior art system. The feeding system includes a low pressure feeder 1 that .conveys chips, that has been steamed in a previous step (not shown), disposed at atmospheric pressure into a chip chute 2 that operates at a slight over-pressure in the chute, there are levels of liquid and chips.

The chips fall by gravity down into a high pressure feeder 3 through a first opening 3*a* in its housing. The high pressure feeder 3 includes rotating pockets so that a first pocket, via the first opening 3*a*, is in direct fluid communication with the chute 2 and, via a second opening 3*b*, in direct communication with a recirculation flow of a recirculation conduit 4. The second opening 3*b* includes a a strainer plate 22. A second pocket is, via a third opening 3*c* defined in the pressure feeder 3, is in direct communication with a return liquid flow in a return line 5 that includes a liquid that has been separated from the chips in a top separator in the treatment vessel. The second pocket is also, via a fourth opening 3*d* defined in the pressure feeder 3, in direct communication with a sluicing conduit or feed line 6 for feeding the chips and an impregnation liquid to the treatment vessel (not shown).

Due to the strainer plate 22 in the second opening 3*b*, the chips are substantially prevented from entering the recirculation flow of the recirculation conduit 4. The second pocket that is in communication with the return line 5 is filled with liquid at a relatively high pressure at the same time as a mixture of chips and liquid, is discharged into the sluicing conduit 6. When the second pocket is moved into the position of the first opening 3*a*, the liquid in the second pocket is again displaced by a mixture of chips and liquid from the chute 2 and discharged into the recirculation conduit 4.

The filling efficiency in the various pockets does, however, not reach the optimum volume since the strainer plate becomes partially plugged by chips. The liquid which has been displaced enters the recirculation conduit 4 and is pumped, by a first pump 7, to a sand trap 8 where sand and other particles are removed from the liquid flow. Thereafter, the liquid recirculation flow of the recirculation conduit 4 continues through an in-line drainer 9 and back into the chute 2. A branch flow in a branch conduit 10 is extracted through a screen disposed in the incline drainer 9 to prevent any chips that might be present in the recirculation flow from entering the branch flow 10. The branch flow is then introduced into a level tank 11 in which a certain liquid level is maintained at all times. The liquid is then pumped, by a second pump 12, which may consist of two or more standard pumps or one high pressure pump, into a conduit 13 from the level tank 11 to the return line 5 that carries the return liquid flow from the treatment vessel in order to provide a portion of the liquid that displaces the chips in the high pressure feader 3.

The liquid in the level tank 11 has mainly three sources including the liquid which is displaced by the chips in the high pressure feeder 3, condensate and water from the chute 2 and any leakage from the high, pressure side to the low pressure side of the high pressure feeder 3. cooking chemicals, especially white liquor, is added to the second pump 12. The flow of the high pressure return liquid in the return line 5 is maintained by a third fluid pump 16.

It is important to maintain a certain liquid level in the chute 2. If the level becomes too high, the liquid may get into the low pressure feeder 1 and the steaming vessel with resulting problems. If the level, on the other hand, is too low, steam may enter the high pressure feeder 3. When steam is allowed to enter the high pressure side of the high pressure feeder 3, the steam may implode due to the high pressure which results in bangs and massive vibrations in the return line 5 and the feed line 6 that extend to the treatment vessel. This may result in severe damages to the return line 5 and the feed line 6.

In conventional feeding systems, the liquid level in the chute 2 is controlled by a chute liquid level control valve 14 that is disposed in the branch conduit 10 between the in line drainer 9 and the level tank 11. If the liquid level in the chute 2 becomes too low, the valve 14 will throttle down and vice versa. The liquid level in the level tank 11 is in turn controlled by a valve 15 in the conduit 13 disposed between the level tank 11 and the return liquid flow in the return line 5. The recirculation flow is in reality controlled by the screening device 22 in the high pressure feeder 3. When the screening device 22 becomes completely plugged, the first pump 7 does not receive any fluid to pump and thus the flow is interrupted.

Figure 2:
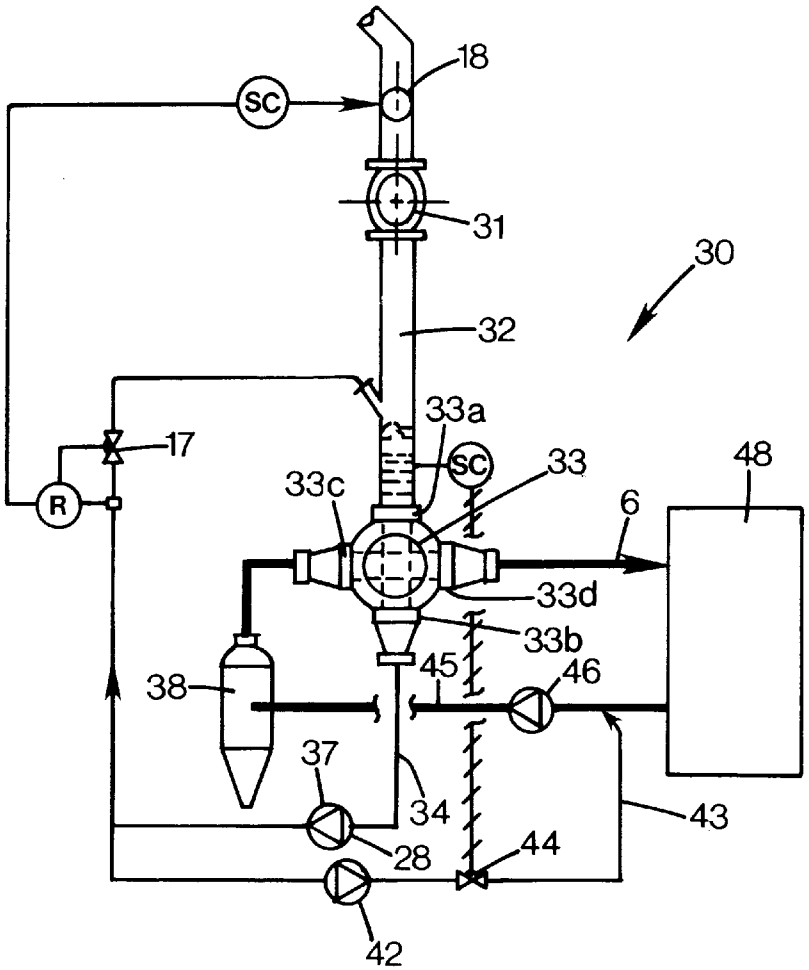
FIG. 2 is a schematic view of a feeding system of a preferred first embodiment of the present invention.

FIG. 2 illustrates a feeding system 30 according to a preferred embodiment of the present invention. Some of the distinguishing features of this embodiment compared to the conventional feeding system shown in FIG. 1 are described below. A high pressure feeder 33 is, according to the present invention, in fluid communication, with respect to both the liquid and chips, with a recirculation flow in a recirculation conduit 34 when any of the pockets of the high pressure feeder 33 is in a location which corresponds to a second opening 33*b* that is connected to the recirculation conduit 34. An important feature of the present invention is that the second opening 33*b* is completely open and lacks any form of a screening device which could prevent the chips from entering the recirculation conduit 34. By eliminating the screen device there is always a fluid communication between a suction side 20 of a first pump 37 and a chute 32 and the liquid level in the chute 32 can be controlled by a chute liquid level control valve 44 that is disposed in line with a second pump 42 or by controlling a rotary speed of the second pump 42. In this way, there is no need for a level tank. An in-line drainer is not needed either since its only function in conventional feeding systems is to prevent chips from entering the level tank where the chips would accumulate. This means that the recirculation conduit 34 of the present invention may extend directly back to the chute 32 or to the high pressure feeder 33. This recirculation flow may be regulated by a valve 17 that is disposed in the recirculation conduit 34 or by controlling the rotary speed of the first pump 37 against the flow of chips that is entering the feeding system 30. The chip flow in the chute 32 may be measured by a measuring device, for example, a so called chip meter screw 18 that may be disposed upstream of a low pressure feeder 31. Some type of regulation of the recirculation flow in the recirculation conduit 34 and thus the first pump 37 is probably required because the first pump 37 is not controlled by any screening device in the high pressure feeder 33. If the recirculation flow is not controlled at all, it may result in an excess amount of chips entering, the recirculation conduit 34. A branch flow of a conduit 43 is, via the pump 42, pumped directly from the recirculation conduit 34 to a return line 45 (that is connected to a digester or impregnation vessel 48) and the branch flow may be controlled by the chute liquid level control valve 44 or by controlling the rotary speed of the second pump 42. By this arrangement, the first pump 37 and the second pump 42 may be coupled in series so that only one standard pump, such as the second pump 42, is sufficient. The return line 45 may also include a sand trap 38 for removing sand, among other things.

Figure 3:
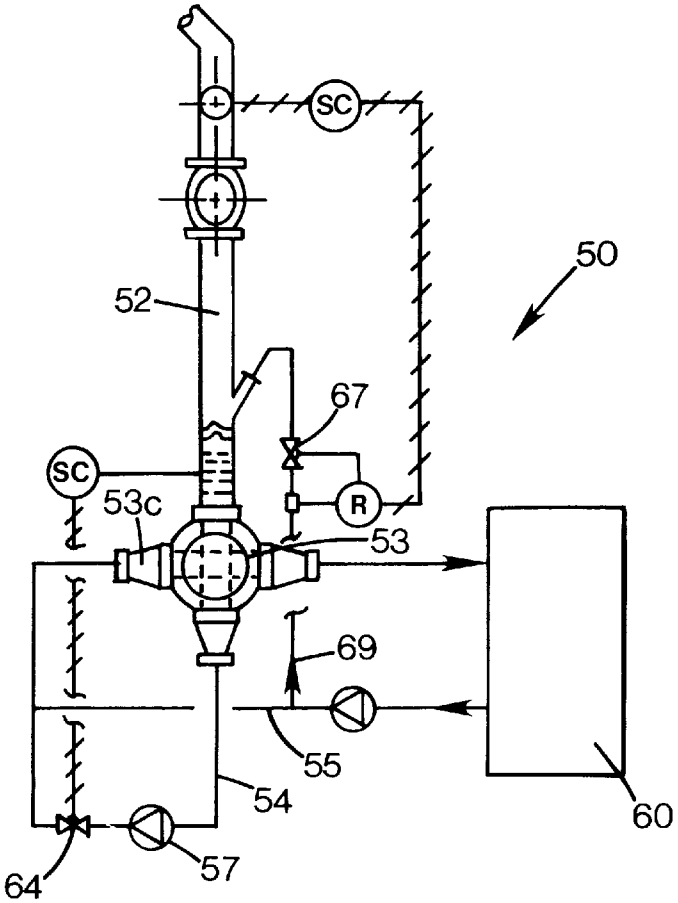
FIG. 3 is a schematic view of a feeding system of a preferred second embodiment of the present invention.

FIG. 3 illustrates a feeding system 50 according to an alternative embodiment of the present invention. In this case, a recirculation flow of a recirculation conduit 54 (in this embodiment called a first recirculation flow) is conveyed to a return liquid flow of a return line 55 and than to a high pressure liquid inlet side 53*c* of a high pressure feeder 53. By using the alternative embodiment, one pump may be saved, compared to the embodiment shown in FIG. 1, but instead the first pump 57 should be a high pressure pump. A second recirculation flow of a second recirculation conduit 69 is preferably conveyed from the return line 55 to the chute 52 to adjust the liquid/wood ratio in the chute 52. The return line 55 is connected to a treatment vessel 60. The second recirculation flow may be controlled by a flow control valve 67 against the flow of chips that is entering the feeding system 50. The first recirculation flow may be regulated by a chute liquid level control valve 64 or by controlling the rotary speed of the first pump 57 against the liquid level in the chute 52.

Figure 4:
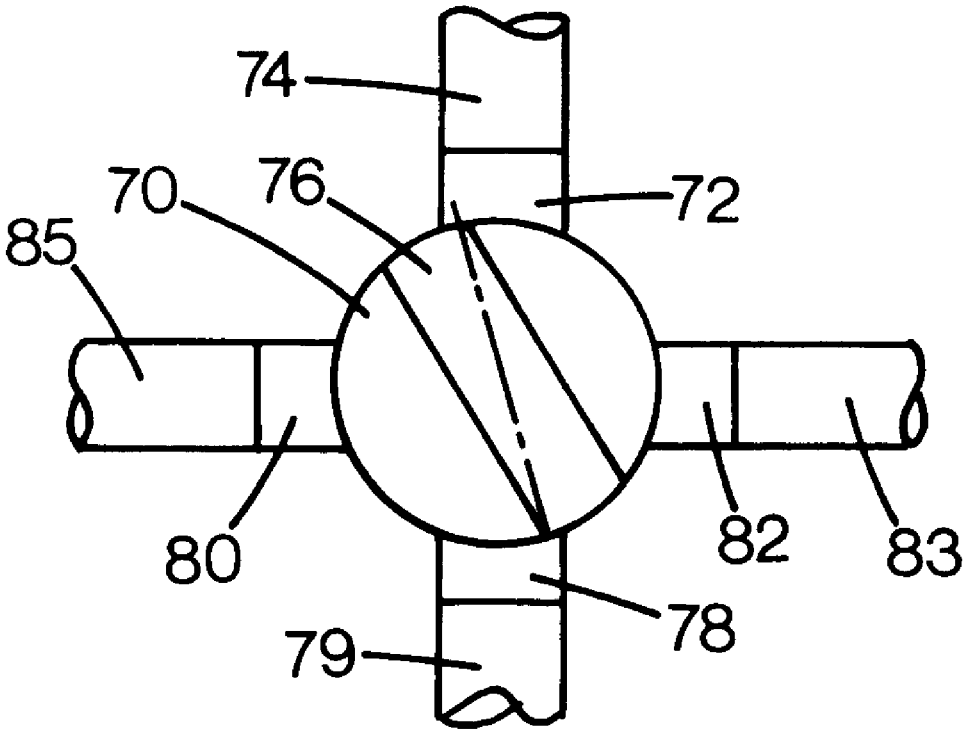
FIG. 4 is a detailed view of the high pressure feeder of the present invention.

FIG. 4 is a detailed view of a rotatable pocket 76 that is defined in a high pressure feeder 70. The detailed description of the pocket 76 and the feeder 70 also applies to the pockets and feeders illustrated in FIGS. 2–3. The feeder 70 has first inlet opening 72 defined therein that is in fluid communication with a chute 74. In the preferred embodiment, the high pressure feeder 70 has at least one elongate and rotatable pocket defined therein. It is to be understood that the feeder 70 preferably has a plurality of pockets but that only one pocket is shown for simplicity. The feeder 70 has a first outlet opening 78 defined therein that is diametrically opposed the first inlet opening 72. Similarly, the feeder 70 hag a second inlet opening 80 and a diametrically opposed second outlet opening 82 defined therein.

The pocket 76 is rotatable within the high pressure feeder 70. Because the pocket 76 extends through the high pressure feeder 70, the first inlet opening 72 may be in fluid communication with the first outlet opening 78 when the pocket 76 is partially aligned (as shown in FIG. 4) or fully aligned with the openings 72, 78. The word alignment should not be narrowly interpreted to be limited to a parallel alignment between the pocket and the openings. The word alignment also includes any position that permits a fluid communication between the pocket 76 and any of the openings 72, 78, 80 and 82.

When the pocket 76 is either partially or fully aligned with the first inlet opening 72 and first outlet opening 78, any fluid or material disposed in the pocket 76 may be ejected through the first outlet opening 78 and into a recirculation line 79 and be replaced by any liquid and material disposed in the chute 74 that may enter into the pocket 76 through the first inlet opening 72. By turning the pocket 76 about 90 degrees counter-clockwise so that the pocket 76 is zither partially or fully aligned with the second inlet opening 80 and the second outlet opening 82, the material and liquid received from the chute 74 may be ejected into the second outlet, opening 82 and into a feed line 83. The ejected material and liquid may in turn be replaced by a liquid from the second inlet opening 82 that is connected to a return line 85. The pocket 76 may then be turned back into a partial or full alignment with the first inlet and outlet openings 80, 82 to receive additional material and liquid from the chute 74. In this way, material and liquid may a efficiently and conveniently be transferred from the low pressure chute 74 into the high pressure feed line 83.

The invention may further include many variations. For example, various equipment may be included in the recirculation conduit although it is preferred that a minimum amount of equipment is used and especially that no level tank is used.

In order to keep an open connection between the high pressure feeder and the recirculation conduit, with respect to both liquid and comminuted cellulose containing material, the relevant opening in the high pressure feeder should be designed to prevent chips from stacking up. Preferably, there are no obstructions at all in the opening. However, a screening device with slots wider than, for instance, 25–30 mm may be included since such a screening device will allow the chips to pass through the opening. Also, it is conceivable that the relevant opening in the high, pressure feeder may be equipped with a screening device with slots narrow enough to make the chips stack up if the screening device is movable and withdrawn from the opening for a substantial part of the time. If the operating conditions otherwise result in an excess of chips entering the recirculation flow, such a screening device could be introduced in the opening just before a pocket is filled up with chips and be withdrawn immediately afterwards when the pocket proceeds to its high pressure position. Additionally, instead of controlling certain flows by regulating them against the flow of chips that is entering the feeding system, as described above, the flows may be regulated against the rotary speed of the pockets in the high pressure feeder. The device that measures the flow of chips that enters the feeding system may also control the number of revolutions of the pump in the flow to be controlled instead of just controlling a valve in the flow.

While the present invention has been described in accordance with preferred compositions and embodiments, it is to be understood that certain substitutions and alterations may be made thereto without departing from the spirit and scope of the following claims.

We claim:

1. A feeding system for feeding comminuted cellulose containing material and liquid to a continuously operating treatment vessel, comprising:

a chute operating at a first pressure and having a first level of a liquid and a first level of a material;

a high pressure feeder having first and second inlets and first and second outlets, the first inlet in operative engagement with the chute, the high pressure feeder having a plurality of rotatable pockets defined therein;

a feed line having one end in operative engagement with the second outlet of the high pressure feeder and an opposite end in operative engagement with a treatment vessel, the feed line maintaining a second pressure for conveying the liquid and material to the treatment vessel, the second pressure being greater than the first pressure;

a return line in operative engagement with the second inlet of the high pressure feeder, the return line carrying a return liquid flow from the treatment vessel; and a first recirculation conduit having one end operatively attached to the first outlet of the high pressure feeder and an opposite end in fluid communication with one of the inlets of the high pressure feeder for conveying a recirculation flow back to the high pressure feeder, the rotatable pockets being rotatable into a position so that at least one of the rotatable pocket is in open fluid communication with both the first inlet and the first outlet of the high pressure feeder, the first outlet being without a screen.

2. The feeding system according to claim 1 wherein the first recirculation conduit extends from the first outlet into the chute.

3. The feeding system according to claim 1 wherein the first recirculation conduit extends from the first outlet into the first inlet of the high pressure feeder.

4. The feeding system according to claim 1 wherein the first recirculation conduit extends from the first outlet into the second inlet of the high pressure feeder.

5. The feeding system according to claim 1 wherein a flow in one of the inlets of the high pressure feeder is regulated by a valve disposed in the first recirculation conduit.

6. The feeding system according to claim 1 wherein a flow in one of the inlets of the high pressure feeder is regulated by a change of a rotary speed of a pump that is disposed in the first recirculation conduit.

7. The feeding system according to claim 1 wherein the first recirculation flow that is Discharged from the high pressure feeder has a volumetric flow that is between 0.8 and 1.5 times a volumetric flow of chips flowing through the high pressure feeder.

8. The feeding system according to claim 1 wherein the first recirculation conduit is attached to the chute and the first recirculation flow is controlled by regulating the first recirculation flow against a flow of the material that enters a low pressure feeder in operative engagement with the chute.

9. The feeding system according to claim 1 wherein the first recirculation conduit is attached to the chute and the first recirculation flow is controlled by regulating the first recirculation flow against a rotary speed of the pockets in the high pressure feeder.

10. The feeding system according to claim 1 wherein a branch conduit extends from the first recirculation conduit to the return line for conveying a branch flow to the return line, the branch conduit has a second pump in operative engagement therewith and coupled in series with a first pump that is in operative engagement with the first recirculation conduit, the branch flow is regulated by the first level of the liquid in the chute.

11. The feeding system according to claim 1 wherein the feeding system comprises a second recirculation conduit for conveying a second recirculation flow from the return line to the chute and the second recirculation flow is regulated against a flow of the material that enters a measuring device in operative engagement with the chute, and the recirculation flow in the first recirculation conduit is regulated against the first level of the liquid in the chute.

12. The feeding system according to claim 1 wherein the chute contains a first mixture of the liquid and the material and the pockets of the high pressure feeder contain a second mixture of the liquid and the material, the first mixture being the substantially similar to the second mixture.

13. The feeding system according to claim 1 wherein a sand trap is disposed in the return line.

14. A feeding system for feeding comminuted cellulose containing material and liquid to a continuously operating treatment vessel, comprising:

a chute operating at a first pressure and having a first level of a liquid and a first level of a material;

a high pressure feeder in operative engagement with the chute, the high pressure feeder having a plurality of rotatable pockets defined therein, the high pressure feeder having a first and second inlet and a first and second outlet, the chute being in fluid communication with the first inlet;

a feed line having one end in operative engagement with the second outlet of the high pressure feeder and an opposite end in operative engagement with a treatment vessel, the feed line maintaining a second pressure for conveying the liquid and material to the treatment vessel, the second pressure being greater than the first pressure;

a return line in operative engagement with the second inlet of the high pressure feeder, the return line carrying a return liquid flow from the treatment vessel; and a first recirculation conduit in operative engagement with the first outlet of the high pressure feeder for conveying a recirculation flow to the first inlet of the high pressure feeder, the first recirculation conduit being in fluid communication with one of the pockets of the high pressure feeder to receive the liquid and the material from a pocket of the high pressure feeder that is at least partially aligned with the first recirculation conduit, the first outlet having a screen having slots defined therein, the slots being wider than 25 millimeters allowing comminuted cellulose containing material to pass through the first outlet and enter the first recirculation conduit.

15. A feeding system for feeding comminuted cellulose containing material and liquid to a continuously operating treatment vessel, comprising:

a chute operating at a first pressure and having a first level of a liquid and a first level of a material;

a high pressure feeder in operative engagement with the chute, the high pressure feeder having a plurality of rotatable pockets defined therein, the high pressure feeder having a first and second inlet and a first and second outlet, the chute being in fluid communication with the first inlet;

a feed line having one end in operative engagement with the second outlet of the high pressure feeder and an opposite end in operative engagement with a treatment vessel, the feed line maintaining a second pressure for conveying the liquid and material to the treatment vessel, the second pressure being greater than the first pressure;

a return line in operative engagement with the second inlet of the high pressure feeder, the return line carrying a return liquid flow from the treatment vessel; and a first recirculation conduit extending from the first outlet to the second inlet of the high pressure feeder for conveying a recirculation flow to the second inlet of the high pressure feeder, the first recirculation conduit being in fluid communication with one of the pockets of the high pressure feeder to receive the liquid and the material from a pocket of the high pressure feeder that is at least partially aligned with the first recirculation conduit, the first outlet being without having a screen.

* * * * *